United States Patent [19]

Ault et al.

[11] 3,967,426

[45] July 6, 1976

[54] REINFORCED COMPOSITE SLAB ASSEMBLY

[75] Inventors: Robert L. Ault, Export, Pa.; Nathan Kelly, Miami, Fla.

[73] Assignee: Epic Metals Corporation, Pittsburgh, Pa.

[22] Filed: May 8, 1972

[21] Appl. No.: 251,419

[52] U.S. Cl. ..... 52/252; 52/263; 52/336

[51] Int. Cl.[2] ..... E04B 1/16

[58] Field of Search ..... 52/329, 335, 336, 252, 52/259, 260, 258, 333, 332

[56] References Cited

UNITED STATES PATENTS

| | | | |
|---|---|---|---|
| 1,060,104 | 4/1913 | Lindar | 52/324 |
| 1,248,049 | 11/1917 | Wander | 52/341 |
| 1,501,288 | 7/1924 | Morley | 52/259 |
| 1,550,810 | 8/1925 | Jabelonsky | 52/329 |
| 1,791,881 | 3/1931 | Yarwood | 52/336 |
| 1,863,258 | 6/1932 | Tashjian | 52/336 |
| 1,905,134 | 4/1933 | Bixby | 52/336 |
| 1,995,585 | 3/1935 | Schlaginweit | 52/319 |
| 2,245,688 | 6/1941 | Krager | 52/336 |
| 3,195,277 | 7/1965 | Grenlich | 52/250 |
| 3,331,169 | 7/1967 | Camming | 52/329 |
| 3,712,010 | 1/1973 | Porter | 52/336 |
| 3,720,029 | 3/1973 | Carran | 52/336 |

FOREIGN PATENTS OR APPLICATIONS

| | | | |
|---|---|---|---|
| 1,125,800 | 11/1956 | France | 52/336 |
| 261,727 | 4/1927 | Italy | 52/319 |
| 712,932 | 9/1966 | Italy | 52/336 |

*Primary Examiner*—Ernest R. Purser
*Assistant Examiner*—H. E. Raduazo
*Attorney, Agent, or Firm*—Arnold B. Silverman

[57] ABSTRACT

A composite slab assembly having an elongated metal deck provided with a number of longitudinally oriented upwardly directed integrally formed ribs and a concrete layer disposed on the metal deck with longitudinally oriented portions in complementary surface to surface engagement with the underlying metal deck. A transversely oriented integral reinforcing beam formed by a thickened portion of the concrete layer and having a lower extremity disposed below the level of the uppermost surfaces of the metal deck. The metal deck having at least one transversely directed discontinuity within which a portion of the transverse beam is received. Reinforcing rods may be provided in the integral reinforcing beam.

The metal deck rib discontinuity may be partial and take the form of a number of longitudinally spaced notches generally aligned with similar notches in other ribs. The discontinuity may also be total with a complete transverse deck gap in the region of the beam.

11 Claims, 6 Drawing Figures

FIG. 2.
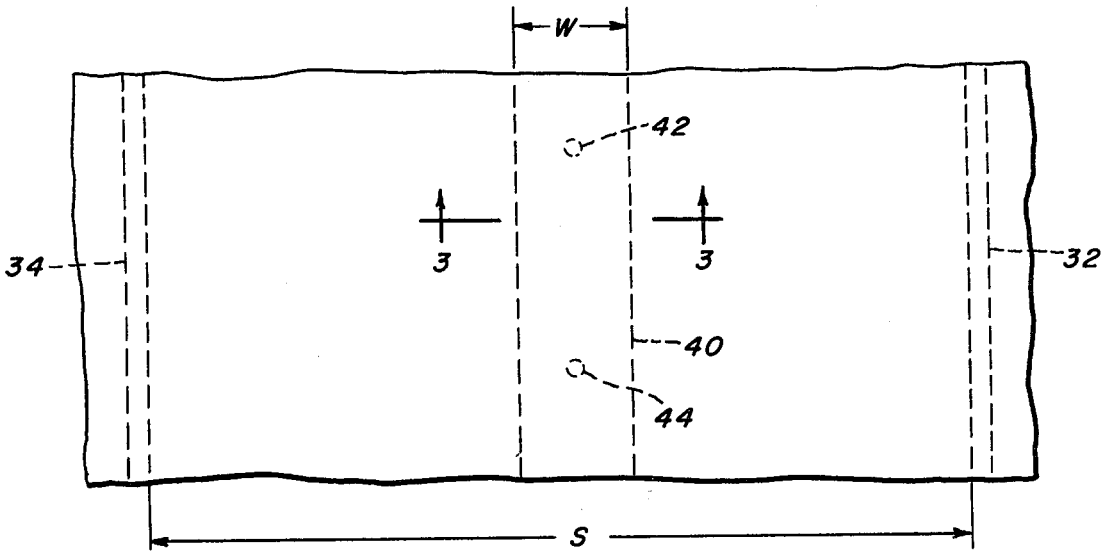
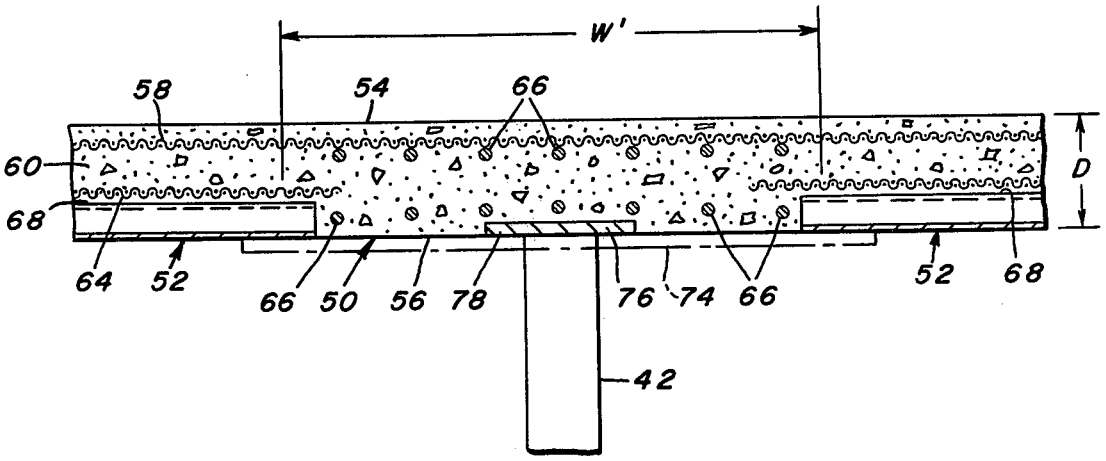
FIG. 3.

REINFORCED COMPOSITE SLAB ASSEMBLY

BACKGROUND OF THE INVENTION

1. Field of the Invention

This invention relates to a metal deck-concrete composite slab structure of the type used in floors and roofs. More specifically, this invention relates to such a composite slab structure having an integrally formed concrete transverse reinforcing beam which permits longer longitudinal spans between adjacent transverse load bearing support walls.

2. Description of the Prior Art

In building construction, economical, strong and durable floor and roof constructions often incorporate an integrally reinforced metal deck member which has an overlying layer of concrete. Such structures frequently have metal deck elements which have integral reinforcement in the form of upwardly projecting hollow ribs with the concrete provided thereover in complementary surface to surface engagement therewith. See U.S. Pat. Nos. 1,073,540, 1,574,586, 1,828,842 and 1,975,842. The interengagement between the metal deck and concrete provides a permanently joined, field created composite slab which will withstand substantial loads without failure or excessive deformation.

As there is a maximum safe length of longitudinal span for such structures, transverse support such as continuous load bearing walls must be provided within predetermined maximum longitudinal span limits. Such limits are established on the basis of gage of the metal in the metal deck, height of the hollow rib, concrete weight per cubic foot, total composite slab depth and desired allowable load on the composite slab. For a given set of conditions, the maximum longitudinal unsupported span serves to create a restriction on flexibility of building design. The span limit prevents the creation of rooms with larger dimensions between load bearing support walls (or other interfering support members, such as transverse structural steel members which limit head room and must be enclosed at added expense). While not directed toward composite slab structures, the awkwardness of enclosing such reinforcing members in all-concrete structures is exemplified by U.S. Pat. Nos. 732,482 and 913,083 wherein all-concrete floors are formed with irregular thickness created by downwardly projecting steel member enclosures which are in turn supported by continuous load bearing walls.

There remains, therefore, a substantial need for an economical means of permitting longer longitudinal spans in composite slabs so as to permit greater design flexibility of building design and improved economy of construction. In addition, there is a particular need for such systems which facilitate the use of a composite slab having a generally uniform thickness between load bearing walls so as to simplify interior finishing, create greater structural symmetry and avoid mechanically and aesthetically undesirable irregular steel support means and enclosures which project downwardly into and partially obstruct the underlying space.

SUMMARY OF THE INVENTION

The above-described need has been met by the composite structure of the present invention. In this construction, an elongated metal deck has a number of longitudinally oriented upwardly directed integrally formed ribs and a concrete layer is provided in overlying complementary surface to surface relationship with respect to the metal deck. A transversely oriented integral reinforcing beam formed by a thickened portion of the concrete layer is provided. The concrete transverse reinforcing beam has a lower extremity disposed below the level of the uppermost surfaces of the metal deck.

In a preferred form, the composite slab has a substantially uniform depth in both the transverse beam regions and in other sectors. The metal deck ribs have at least one transversely directed discontinuity within which a portion of the transverse concrete beam is received.

Column means provide independent elements of support for the concrete beam. The transverse concrete beam may be provided with a width substantially greater than the width of the supporting column means.

In one preferred form, the metal deck has a discontinuity at the location of the beam and the beam structure will have no underlying metal deck. In another preferred embodiment, the metal deck longitudinal ribs have a number of longitudinally spaced notches which are generally aligned with similar notches in adjacent ribs, with the concrete beam being received within the notches. Reinforcing bars oriented in the same direction as the transverse beam may be provided.

It is an object of this invention to provide a composite metal deck-concrete slab which has integral transverse reinforcement so as to permit longer longitudinal spans between adjacent load bearing supporting walls or structural steel supporting members.

It is another object of this invention to provide such a composite slab construction wherein the slab may have a substantially uniform depth even in regions wherein the beam is disposed.

It is another object of this invention to permit economical fabrication of the transverse reinforcing beam in such a fashion as to permit maximum structural design flexibility and eliminate undesired head room restricting downwardly projecting reinforcing means.

It is yet another object of this invention to provide such a composite beam assembly which is compatible with conventional composite slab floor and roof construction procedures and designs.

These and other objects of the invention will be more fully understood from the following description of the invention, on reference to the illustrations appended hereto.

BRIEF DESCRIPTION OF THE DRAWINGS

FIG. 2 is a partially schematic top plan view of a section of the composite slab of this invention.

FIG. 3 is a cross sectional illustration, taken through 3—3 of FIG. 2, showing one form of transverse beam construction of this invention.

DESCRIPTION OF THE PREFERRED EMBODIMENTS

Figure 1:
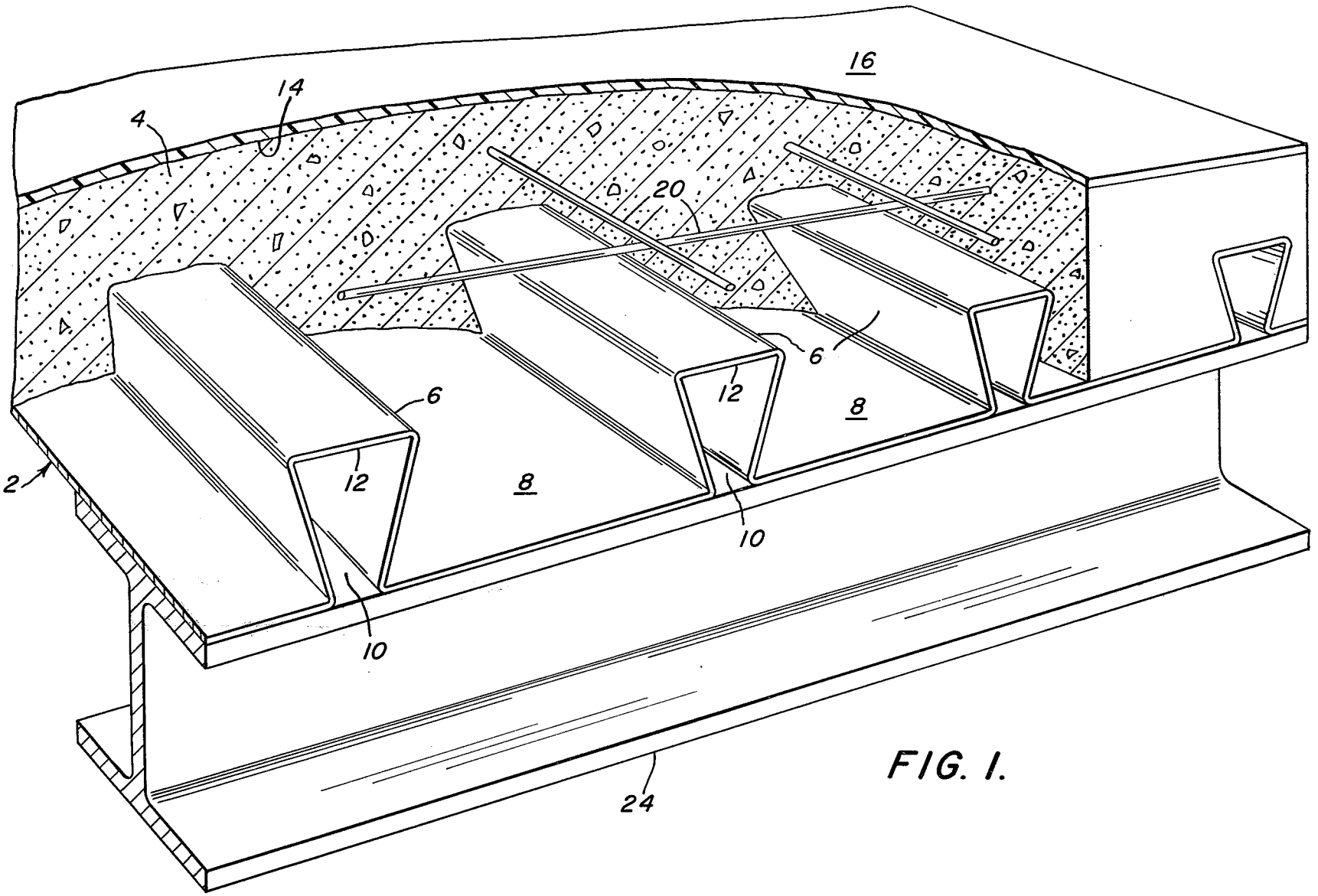
FIG. 1 is a fragmentary perspective view of a section of a composite slab of a type employable in this invention.

Referring now more particularly to FIG. 1, there is shown a composite slab assembly having a metal deck 2 and an overlying concrete layer 4. It is noted that the metal deck 2 has a plurality of longitudinally oriented hollow ribs 6 disposed in generally parallel spaced relationship with respect to each other. A number of flat panel sections 8 are disposed between adjacent ribs 6. In the form shown, the hollow ribs 6 are generally triangular and have a restricted throat opening 10 which is narrower than top wall 12. This provides for a keyed form of interlock between the hollow ribs 6 and the concrete layer 4. If desired, the concrete engaging hollow ribs may be so configurated as to provide a throat which is equal to or larger than the rib top wall. As used herein, reference to the concrete and the metal deck being in "surface to surface engagement" and words of similar import shall include all of these forms of engagement, as well as other structural arrangements wherein portions of a metal deck extend upwardly into an overlying concrete layer to provide generally complementary interengagement therebetween.

Also shown in FIG. 1 is a generally flat upper surface 14 of the concrete layer floor which, in the form shown, is provided with an overlying floor layer 16. The flat upper surface 14 facilitates ready application of floor or roof materials upon the composite slab.

Among the additional features shown in FIG. 1 is the use of reinforcement means 20 in the concrete. The reinforcement means shown is a wire mesh which is positioned within the concrete layer 4 at an elevation higher than the uppermost surfaces of the metal deck 2, which in this instance would be the top walls 12 of the ribs 6.

The composite slab of FIG. 1 is shown as being supported by a transversely positioned I-beam 24 which has its upper flanges in underlying supporting contact with respect to flat panel sections 8 of metal deck 2. The I-beam 24 may be supported at its ends or directly thereunder by a suitable load bearing wall structure (not shown).

Referring now to FIG. 2, there is shown a slab section wherein the longitudinal ribs 6 (not shown in this view) of the metal deck will run longitudinally from solid transverse load bearing wall 32 to solid transverse load bearing wall 34 (or alternatively between a pair of spaced I-beams such as I-beam 24 of FIG. 1 positioned where support walls 32, 34 are disposed). Similarly, the overlying concrete will have metal rib receiving voids which are also oriented longitudinally between walls 32 and 34. The span "S" of the composite slab is the distance between walls 32 and 34. As has been stated above, in conventional prior practices, for a given set of conditions, a very definite and design limiting maximum span S is established. Under the practice of the present invention the span S will have a meaningfully increased magnitude without loss of structural capabilities, thereby facilitating numerous structural and aesthetic advantages.

As is shown in FIG. 2, the structure of the present invention is provided with a transverse concrete reinforcing beam 40 which is integrally formed within the concrete layer 4. The integral concrete beam 40 is preferably so proportioned as to create a maximum composite slab depth within the beam area which is less than or generally equal to the maximum composite slab depth in the remaining regions thereof. In determining maximum slab depth, the metal deck panel sections 8 may be considered as being disposed generally within a first plane, the rib top walls 12 may be considered as being disposed generally within a second plane substantially parallel to and above said first plane and the upper surface of the concrete layer 14 may be considered as being disposed generally within a third plane which is above and substantially parallel to said first and second planes. The lower extremity of the composite slab is defined generally by the first plane and the maximum depth of the composite slab is substantially equal to the distance between the first and third planes. The maximum depth of the composite slab in the sector of the transverse concrete beam is less than or generally equal to the maximum depth of the composite slab in remaining portions thereof. This provides the structural advantage of establishing the desired transverse reinforcement, while preserving the uniform composite slab dimension in terms of both aesthetic desires and facilitating uniformity of building space by eliminating undesired downwardly projecting reinforcing means which reduce head room. The concrete beam 40 preferably has a width which is about 2.5 to 9 times the average full depth of the composite slab in regions adjacent the beam 40. In connection with the beam 40, it will be appreciated that the beam is preferably assembled as a unit, but if desired a number of partial width beams may be provided either immediately adjacent each other or spaced from each other such that the total reinforcement of the individual beams equals that which would be provided by a single beam. The use of the term "concrete beam" herein is intended to encompass closely adjacent segmented beam structures which function essentially as a unit.

Referring once again to FIG. 2, it is noted that the concrete beam 40 is supported by means of two individual circular stub column members 42, 44 which are preferably of substantially smaller width that the width W of the beam. In general, columns 42, 44 will be of smaller width than load bearing walls 32, 34. As a result, they provide the distinct advantage of not only eliminating the need for a full load bearing wall underlying transverse beam 40, but also are sufficiently small to be left exposed with or without suitable covering or may be readily concealed within an ordinary partition wall which may be provided with desired openings such as doors. As a result, this form of discontinuous support contributes meaningfully to design flexibility by providing beam support solely at transversely spaced locations.

Referring now to FIG. 3, one preferred embodiment of the invention will be considered. In the form shown in FIG. 3, the beam 50 has a width W′ and a depth D which is equal to the full depth of the composite slab. It is noted that the metal deck 52 has a total discontinuity in the regions underlying the beam 50 such that the beam 50 extends continuously from its upper surface 54 to its lower surface 56 and preferably has no underlying portions of the metal deck 52. The deck 52 has two sections with spaced generally aligned edges separated by lower portions of the beam 50. As used herein, or convenience of reference, the term "total discontinuity" shall refer to (1) substantially complete removal of a transverse section of deck to create a complete gap therein or (2) at minimum substantially complete removal of all of the ribs within such section while retaining all or portions of panel sections 8 and reference to the term "partial discontinuity" shall refer to removal within a transverse section of deck of only portions of the ribs with or without total or partial removal of panel sections 8. A reference to a deck having a "partial or total discontinuity" shall mean that in respect of a transverse section of the deck (1) at least a major number of ribs have a total discontinuity or (2) at least a major number of ribs have a partial discontinuity or (3) that the transverse deck section has a number of ribs with a partial discontinuity and a number of ribs with a total discontinuity.

While it may be desirable in some instances to leave portions of the spaced metal deck sections 52 interconnected as by panel sections 8, the present embodiment requires no continuous underlying support for the transverse beam 50. It is noted that reinforcing wire mesh 58 is provided within the concrete layer 60 at a position spaced closely adjacent from upper surface 54. Also, additional wire mesh 64 is provided adjacent the lower regions of the concrete layer 60.

Referring once again to FIG. 3, it is noted that a plurality of reinforcing rods 66 are disposed within the transverse beam 50 and extend longitudinally therealong, with all portions along the length of beam 50 preferably having at least some reinforcing rods 66. In the form shown, the reinforcing rods 66 have a lower grouping disposed beneath the level of the uppermost surface 68 of metal deck 52 and upper grouping disposed above the level of surface 68.

In forming the integrally constructed transverse beam 50, suitable forms are provided in order to establish the desired contour of the concrete and support therefor during the setting period. An underlying wooden form 74 is shown in FIG. 3. It will be appreciated that suitable forms would be provided at opposed ends of the concrete beam 50 to define the ends thereof.

It is noted that column 42 terminates in a flange 76 which is in underlying supporting position with respect to beam 50. In order to facilitate uniformity of slab depth throughout, the flange 76 has been so positioned that its lower surface 78 is generally level with the lower surface 56 of beam 50.

Figure 4:
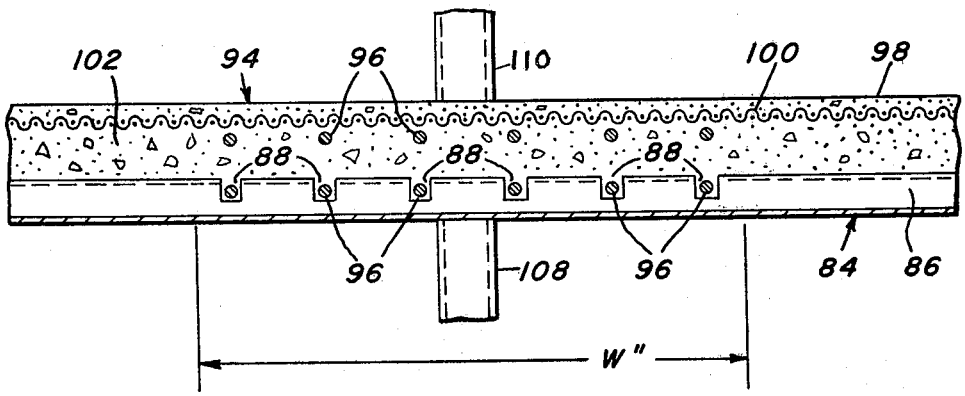
FIG. 4 is a cross sectional view similar to FIG. 3, but showing a different embodiment of transverse beam construction of this invention.

Referring now to FIG. 4, another embodiment of the invention will be considered. In this form of the invention the metal deck 84 has a partial discontinuity. A plurality of upwardly directed hollow ribs 86 are provided with a number of longitudinally spaced notches 88. Notches 88 of one rib 86 preferably are transversely aligned with notches of adjacent ribs. The beam 94, which has portions received within the notches, has a width W'' and is preferably provided with generally continuous underlying support from the metal deck 84. The beam 94 is also provided with a plurality of reinforcing bars 96 which are of such size and spacing as to provide the desired structural reinforcement to the beam 94. In the form shown, multiple levels of reinforcing bars 96 are provided. In this form, as was true of the form shown in FIG. 3, a number of the reinforcing bars 96 is shown positioned at a level lower than the uppermost surface of metal deck 84. Also shown in this view is an upper wire mesh 100 which extends through concrete layer 102 and provides reinforcement thereto. In this embodiment, as was true of the FIG. 3 embodiment, the overall full composite slb depth in the beam area is equal to the depth in remaining portions of the slab. Also, the upper surface 98 of the concrete layer 102 is substantially flat to facilitate providing an unobstructed floor traffic area.

In the embodiment shown in FIG. 4, the use of an underlying concrete form is not essential as the metal deck 84 serves as a form. If desired, forming members may be positioned under the notches 88, but concrete leakage in these areas should pose no problems even in the absence of such forming members.

FIG. 4 has column 108 in underlying supporting relationship with respect to beam 94 which in turn supports column 110 which in turn may be employed as a further support for overlying building portions.

Figure 5:
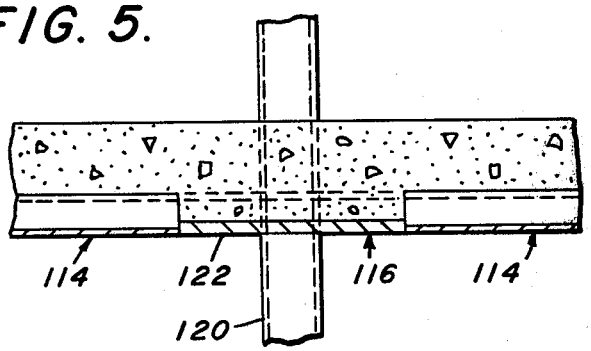
FIGS. 5 and 6 show fragmentary cross sectional representations of two forms of column support members of this invention.
Figure 6:
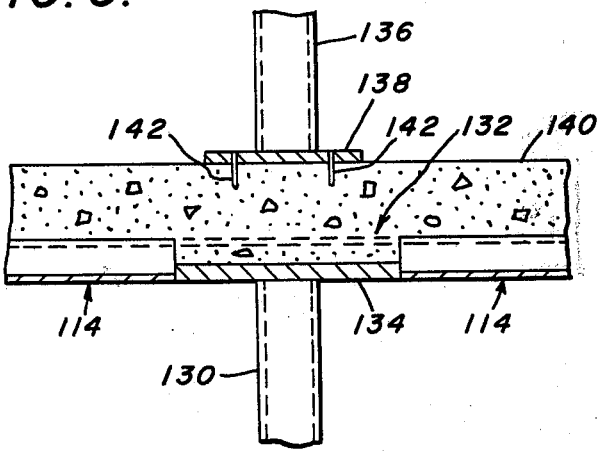

Referring now to FIGS. 5 and 6, two different forms of exemplary column structures which may advantageously be employed with the structure of this invention will be considered. In FIG. 5, the metal deck 114 may have a discontinuity in the region of beam 116 or may be provided with a modified metal deck structure such as that shown in FIG. 4 or other suitable modifying structures. The column 120 extends continuously from a level below the composite slab to a level above the same. A column stabilizing collar 122 is positioned within the lower portion of beam 116 and serves to resist undesired lateral displacement of the column 120 respect to the composite slab.

In the form shown in FIG. 6, a first column 130 is an underlying supporting relationship with respect to beam 132 and is secured to support plate 134. A second column 136 rests upon support plate 138 which is secured to the concrete layer 140 by means of suitable fasteners 142.

It will be appreciated that the preferred and generally most advantageous practice of this invention provides an integral concrete reinforcing beam such that the slab depth remains generally the same within and without the beam regions. It is understood, however, that for certain installations departures from the preferred practice by use of beams which projects above the upper level of the remainder of the slab or below the lower level of the remainder of the composite slab may be desirable. Such departures, while not affording the maximum benefits of the invention, nevertheless fall within the scope of the present invention.

It will, therefore, be appreciated that the monolithic composite slab structure of the present invention provides an economical means of establishing integral concrete transverse beam support, while preserving the desired uniformity of composite slab depth and facilitating the use of increased longitudinal span lengths between full load bearing transverse supports. All of this is accomplished while preserving the desired functional characteristics of the composite slab and adopting otherwise conventional techniques. The composite slab not only improves aesthetic appearance of the undersurface of the floor or roof, but also permits more uniform designing of the rooms or other spaces within the building structure as undesired head space obstructions may be eliminated by use of the integral beam. Not only is uniformity of composite slab thickness maintained, but also no increase in overall depth of the slab is required. The advantageous practice of this invention may be used broadly over a wide range of types of metal deck profiles, composite slab thicknesses and types of floor and roof designs.

While for purposes of illustration specific forms of metal deck profiles and specific preferred transverse concrete beam configurations have been shown, it will be appreciated that the advantageous features of this invention are not so limited and modifications thereof will be apparent to one skilled in the art.

Whereas particular embodiments of the invention have been described above for purposes of illustration, it will be evident to those skilled in the art that numerous variations of the details may be made without departing from the invention as defined in the appended claims.

We claim:

1. A composite slab assembly comprising an elongated metal deck having a number of longitudinally oriented upwardly directed downwardly open integrally formed ribs disposed in alternating relationship with respect to elongated panel sections of said metal deck, said metal deck panel sections disposed generally within a first plane and said ribs having upper wall portions disposed generally within a second plane generally parallel to and above said first plane, said downwardly open ribs having a restricted throat opening which is narrower than said rib upper wall portion, a concrete layer disposed on said metal deck and having longitudinally oriented portions in complementary surface to surface engagement with said metal deck, thereby causing said metal deck into a unitary composite structure, a transversely oriented integral reinforcing beam formed by thickened portions of said concrete layer, said metal deck having at least one total discontinuity within which at least a portion of said transverse concrete beam is received, said upper surface of said concrete layer being disposed generally in a third plane which is above and substantially parallel to said first and second planes, the lower extremity of said slab being defined generally by said first plane, the maximum depth of said composite slab being substantially equal to the distance between said first and said third planes, said composite slab having a maximum depth in the sector of said transverse concrete beam less than or generally equal to the maximum depth or said composite slab in remaining portions thereof, said transverse reinforcing beam having a lower extremity disposed below the level of said second plane, at least one elongated generally transversely oriented reinforcing member disposed within and reinforcing said transverse concrete beam, and support means transversely discontinuously supporting said transverse concrete beam, whereby said composite slab will be monolithic and devoid of filler joists and will span greater lengths between adjacent transverse continuous support walls or members than would be the case without said transverse concrete beam.

2. A composite slab assembly comprising an elongated metal deck having a number of longitudinally oriented upwardly directed downwardly open integrally formed hollow ribs disposed in alternating relationship with respect to elongated panel sections of said metal deck, said metal deck panel sections disposed generally within a first plane and said ribs having upper wall portions disposed generally within a second plane generally parallel to and above said first plane, said metal deck hollow ribs being generally triangular in shape with a restricted throat opening, said deck ribs being in keyed interlocked relationship with respect to said concrete, a concrete layer disposed on said metal deck and having longitudinally oriented portions in complementary surface to surface engagement with said metal deck, thereby securing said metal deck into a unitary composite structure, a transversely oriented integral reinforcing beam formed by thickened portions of said concrete layer, said metal deck having at least one total discontinuity within which at least a portion of said transverse concrete beam is received, the upper surface of said concrete layer being disposed generally in a third plane which is above and substantially parallel to said first and second planes, the lower extremity of said slab being defined generally by said first plane, the maximum depth of said composite slab being substantially equal to the distance between said first and said third planes, said composite slab having a maximum depth in the sector of said transverse concrete beam less than or generally equal to the maximum depth of said composite slab in remaining portions thereof, said transverse reinforcing beam having a lower extremity disposed below the level of said second plane, at least one elongated generally transversely oriented reinforcing member disposed within and reinforcing said transverse concrete beam, and support means transversely discontinuously supporting said transverse concrete beam, whereby said composite slab will be monolithic and devoid of filler joists and will span greater lengths between adjacent transverse continuous support walls or members than would be the case without said transverse concrete beam.

3. The composite slab assembly of claim 2 including said supporting means being column means.

4. The composite slab assembly of claim 2 including said elongated metal deck being generally horizontally disposed, and said composite slab having a maximum depth in the section of said transverse concrete beam substantially equal to the maximum depth of said composite slab in the remaining portions thereof.

5. The composite slab assembly of claim 3 including said transverse concrete beam having a width substantially greater than the width of said supporting column means.

6. The composite slab assembly of claim 4 including said reinforcing members including a number of reinforcing bars disposed within said transverse concrete beam oriented in the same direction as said beam.

7. The composite slab assembly of claim 6 including portions of said generally horizontally disposed metal deck terminating in spaced generally aligned edges disposed on opposed sides of a lower portion of said beam.

8. The composite slab assembly of claim 5 including a pair of transverse load bearing members longitudinally spaced from each other in underlying supporting relationship with respect to said composite slab, and said transverse concrete beam and said column means providing the sole transverse support between said load bearing members.

9. The composite slab of claim 3 including said column means being individual column members transversely spaced from each other.

10. The composite slab of claim 6 including said transverse concrete beam having a width of about 2.5 to 9 times the average composite slab depth adjacent said transverse beam.

11. The composite slab assembly of claim 7 including said transverse concrete beam having a maximum depth generally equal to the maximum depth of adjacent portions of said composite slab.

* * * * *

UNITED STATES PATENT AND TRADEMARK OFFICE

CERTIFICATE OF CORRECTION

PATENT NO. : 3,967,426

DATED : July 6, 1976

INVENTOR(S) : Robert L. Ault et al

It is certified that error appears in the above-identified patent and that said Letters Patent are hereby corrected as shown below:

| | |
|---|---|
| Col. 3, line 4 | Change "particularly" to --specifically--. |
| Col. 4, line 63 | Change "or" to --for--. |
| Col. 5, line 66 | Change "slb" to --slab--. |
| Col. 6, line 25 | Before "respect" insert --with--. |
| Col. 6, line 26 | Change "an" to --in--. |
| Col. 6, line 38 | Change "projects" to --project--. |
| Col. 7, line 26 | Change "causing" to --securing--. |
| Col. 7, line 34 | Before "upper" change "said" to --the--. |
| Col. 8, line 45 | Change "supporting" to --support--. |

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*